US010302307B2

(12) United States Patent
Burdett et al.

(10) Patent No.: US 10,302,307 B2
(45) **Date of Patent: *May 28, 2019**

(54) AUTONOMOUS VENTILATION SYSTEM

(71) Applicant: Oy Halton Group Ltd., Helsinki (FI)

(72) Inventors: Michael P. Burdett, Tucson, AZ (US); Daniel Reich, Tuscon, AZ (US)

(73) Assignee: Oy Halton Group Ltd., Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/438,840

(22) Filed: Feb. 22, 2017

(65) Prior Publication Data

US 2017/0159943 A1 Jun. 8, 2017

Related U.S. Application Data

(60) Division of application No. 14/223,286, filed on Mar. 24, 2014, now Pat. No. 9,587,839, which is a (Continued)

(51) Int. Cl.

| | |
|---|---|
| ***F24C 15/20*** | (2006.01) |
| ***B08B 15/02*** | (2006.01) |
| *F24F 11/30* | (2018.01) |

(52) U.S. Cl.

CPC ..... *F24C 15/20* (2013.01); *B08B 15/02* (2013.01); *F24C 15/2021* (2013.01); *F24F 11/30* (2018.01)

(58) Field of Classification Search

CPC ..... F24C 15/20

(Continued)

(56) References Cited

U.S. PATENT DOCUMENTS 2,743,529 A 5/1956 Hayes et al.
2,833,615 A 5/1958 Kollgaard
(Continued)

FOREIGN PATENT DOCUMENTS

AU 1138776 A 9/1977
AU 3400697 A 1/1998
(Continued)

OTHER PUBLICATIONS

Abstract for Gidaspow, D. "Multiphase Flow and Fluidization-Continuum and Kinetic Theory Descriptions", Academic Press 1994.

(Continued)

*Primary Examiner* — Gregory L Huson
*Assistant Examiner* — Frances F. Hamilton
(74) *Attorney, Agent, or Firm* — Potomac Law Group, PLLC; Mark Catan

(57) ABSTRACT

An autonomous ventilation system includes a variable-speed exhaust fan, a controller, an exhaust hood, and an infrared radiation ("IR") sensor. The exhaust fan removes air contaminants from an area. The controller is coupled to the exhaust fan and adjusts the speed of the exhaust fan. The exhaust hood is coupled to the exhaust fan and directs air contaminants to the exhaust fan. The IR sensor is coupled to the controller, detects changes in IR index in a zone below the exhaust hood, and communicates information relating to detected changes in IR index to the controller. The controller adjusts the speed of the exhaust fan in response to information relating to detected changes in IR index. The autonomous ventilation system also includes an alignment laser to indicate a point at which the IR sensor is aimed and a field-of-view ("FOV") indicator to illuminate the zone in which the IR sensor detects changes in IR index.

20 Claims, 8 Drawing Sheets

Related U.S. Application Data continuation of application No. 13/187,762, filed on Jul. 21, 2011, now Pat. No. 8,795,040, which is a continuation of application No. 11/947,924, filed on Nov. 30, 2007, now abandoned.

(60) Provisional application No. 60/968,395, filed on Aug. 28, 2007.

(58) Field of Classification Search
USPC ..... 454/56, 58, 67, 61, 37
See application file for complete search history.

(56) References Cited

U.S. PATENT DOCUMENTS 2,853,367 A 9/1958 Berton et al.
2,862,095 A 11/1958 Scofield
2,933,080 A 4/1960 Adey
3,045,705 A 7/1962 Hausammann
3,254,588 A 6/1966 Truhan et al.
3,323,439 A 6/1967 Weaver et al.
3,332,676 A 7/1967 Namy
3,381,134 A 4/1968 Wolf
3,386,365 A 6/1968 Jensen
3,400,649 A 9/1968 Jensen
3,441,348 A * 4/1969 Anderson ..... G01J 5/48 356/43
3,457,850 A 7/1969 Sweet et al.
3,513,766 A 5/1970 Ahlrich
3,536,457 A 10/1970 Henderson
3,612,106 A 10/1971 Camboulives et al.
3,690,245 A 9/1972 Ferlise et al.
3,752,056 A 8/1973 Chamberlin et al.
3,809,480 A 5/1974 Somerville et al.
3,825,346 A 7/1974 Rizzo
3,829,285 A 8/1974 Beck
3,866,055 A 2/1975 Pike
3,895,569 A 7/1975 Miller
3,943,836 A 3/1976 Kuechler
3,952,640 A 4/1976 Kuechler
3,978,777 A 9/1976 Nett
4,043,319 A 8/1977 Jensen
4,047,519 A 9/1977 Nett
4,050,368 A 9/1977 Eakes
4,056,877 A 11/1977 Kuechler
4,085,736 A 4/1978 Kuechler
4,105,015 A 8/1978 Isom
4,109,641 A 8/1978 Hunzicker
4,113,439 A 9/1978 Ookubo et al.
4,117,833 A 10/1978 Mueller
4,127,106 A 11/1978 Jensen
4,134,394 A 1/1979 Otenbaker
4,138,220 A 2/1979 Davies et al.
4,146,017 A 3/1979 Overton
4,147,502 A 4/1979 Milton
4,153,044 A 5/1979 Nett
4,155,348 A 5/1979 Ahlrich
4,160,407 A 7/1979 Duym
4,211,154 A 7/1980 Eakes
4,213,947 A 7/1980 Fremont et al.
4,285,390 A 8/1981 Fortune et al.
4,286,572 A 9/1981 Searcy et al.
4,287,405 A 9/1981 Ohmae et al.
4,346,692 A 8/1982 McCauley
4,350,166 A 9/1982 Mobarry
4,373,507 A 2/1983 Schwartz et al.
4,398,415 A 8/1983 Jacocks et al.
4,467,782 A 8/1984 Russell
4,475,534 A 10/1984 Moriarty
4,483,316 A 11/1984 Fritz et al.
4,484,563 A 11/1984 Fritz et al.
4,497,242 A * 2/1985 Moyer ..... B08B 15/023 454/61
4,556,046 A 12/1985 Riffel et al.
4,583,814 A * 4/1986 Koetser ..... G01J 5/06 250/352
4,584,929 A 4/1986 Jarmyr et al.
4,586,486 A 5/1986 Kaufman
4,617,909 A 10/1986 Molitor
4,655,194 A 4/1987 Wooden
4,706,553 A 11/1987 Sharp et al.
4,773,311 A 9/1988 Sharp
4,781,460 A 11/1988 Bott
4,788,905 A 12/1988 Kohorn
4,793,715 A 12/1988 Kasner et al.
4,811,724 A 3/1989 Aalto et al.
4,813,397 A 3/1989 Yamada
4,823,015 A 4/1989 Galvin et al.
4,831,747 A 5/1989 Roos et al.
4,856,419 A 8/1989 IMai
4,872,892 A 10/1989 Vartiainen et al.
4,903,685 A * 2/1990 Melink ..... F24C 15/2021 126/299 D
4,903,894 A 2/1990 Pellinen et al.
4,921,509 A 5/1990 Maclin
4,934,256 A 6/1990 Moss et al.
4,944,283 A 7/1990 Tsuchiya et al.
4,944,285 A 7/1990 Glassman
5,033,508 A 7/1991 Laverty
5,042,453 A 8/1991 Shellenberger
5,042,456 A 8/1991 Cote
5,050,581 A 9/1991 Roehl-Hager et al.
5,063,834 A 11/1991 Aalto et al.
5,090,303 A 2/1992 Ahmed
5,092,227 A 3/1992 Ahmed et al.
5,115,728 A 5/1992 Ahmed et al.
5,139,009 A 8/1992 Walsh
5,146,284 A 9/1992 Tabarelli et al.
5,172,978 A * 12/1992 Nomura ..... G01J 5/08 250/353
5,205,783 A 4/1993 Dieckert et al.
5,209,217 A 5/1993 Beach et al.
5,213,091 A 5/1993 Beach
5,215,075 A 6/1993 Caridis et al.
5,215,497 A 6/1993 Drees
5,220,910 A 6/1993 Aalto et al.
5,240,455 A * 8/1993 Sharp ..... B08B 15/023 454/343
5,251,608 A 10/1993 Cote
5,268,739 A 12/1993 Martinelli et al.
5,311,930 A 5/1994 Bruenn
5,312,296 A 5/1994 Aalto et al.
5,312,297 A 5/1994 Dieckert et al.
5,325,842 A 7/1994 Beach et al.
5,331,825 A * 7/1994 Kim ..... F24F 11/0034 236/51
5,394,861 A 3/1995 Stegmaier
5,406,073 A * 4/1995 Sharp ..... G01V 8/10 250/221
5,414,509 A 5/1995 Veligdan
5,415,583 A 5/1995 Brandt
5,460,451 A * 10/1995 Wadman ..... B23K 26/032 219/502
5,518,446 A 5/1996 Jacob
5,522,377 A 6/1996 Fritz
5,524,984 A * 6/1996 Hollander ..... G01J 5/02 33/DIG. 21
5,558,821 A 9/1996 Konig
5,580,535 A 12/1996 Hoke et al.
5,597,354 A 1/1997 Janu et al.
5,622,100 A 4/1997 King et al.
5,657,744 A 8/1997 Vianen
5,713,346 A 2/1998 Kuechler
5,716,268 A 2/1998 Strongin et al.
5,718,219 A 2/1998 Boudreault
5,720,274 A 2/1998 Brunner et al.
5,764,579 A 6/1998 McMasters et al.
5,779,538 A 7/1998 Jardinier
5,874,292 A 2/1999 McMinn
5,882,254 A * 3/1999 Jacob ..... B08B 15/023 454/56
5,960,786 A 10/1999 Lambertson

(56) References Cited

U.S. PATENT DOCUMENTS 5,992,152 A 11/1999 Weres et al.
6,044,838 A 4/2000 Deng
6,058,929 A 5/2000 Fritz
6,089,970 A 7/2000 Feustel
6,154,686 A * 11/2000 Hefferen ..... B08B 15/023 454/59
6,170,480 B1 * 1/2001 Melink ..... F24C 15/2021 126/299 D
6,171,480 B1 1/2001 Lee et al.
6,173,710 B1 1/2001 Gibson et al.
6,179,763 B1 1/2001 Phillips
6,215,588 B1 * 4/2001 Wachi ..... G02B 21/0004 345/632
6,252,689 B1 6/2001 Sharp
6,336,451 B1 1/2002 Röehl-Hager et al.
6,347,626 B1 2/2002 Yi
6,351,999 B1 3/2002 Maul et al.
6,401,669 B1 6/2002 Macgowan et al.
6,428,408 B1 8/2002 Bell et al.
6,450,879 B1 9/2002 Suen
6,515,283 B1 2/2003 Castleman et al.
6,531,966 B2 3/2003 Krieger
6,549,554 B2 4/2003 Shiojima et al.
6,645,066 B2 11/2003 Gutta et al.
6,669,547 B2 12/2003 Liu
6,752,144 B1 6/2004 Lee
6,782,294 B2 8/2004 Reich et al.
6,824,317 B2 * 11/2004 Finizio ..... G03B 17/00 348/143
6,846,236 B2 1/2005 Gregorigka
6,851,421 B2 2/2005 Livchak et al.
6,869,468 B2 3/2005 Gibson
6,878,195 B2 4/2005 Gibson
6,890,252 B2 5/2005 Liu
6,899,095 B2 5/2005 Livchak et al.
6,916,239 B2 7/2005 Siddaramanna et al.
6,920,874 B1 7/2005 Siegel
6,974,380 B2 12/2005 Cui et al.
7,048,199 B2 5/2006 Melink
7,088,525 B2 * 8/2006 Finizio ..... G03B 17/00 348/E5.026
7,147,168 B1 12/2006 Bagwell et al.
7,258,280 B2 8/2007 Wolfson
7,317,970 B2 * 1/2008 Pienta ..... G05D 23/1905 236/91 D
7,318,771 B2 1/2008 Huang et al.
7,364,094 B2 4/2008 Bagwell et al.
7,442,119 B2 10/2008 Fluhrer
7,488,919 B2 * 2/2009 Gagas ..... F24C 7/087 219/400
7,699,051 B2 * 4/2010 Gagas ..... F24C 15/2028 126/299 D
7,717,107 B2 5/2010 Ota
7,724,412 B2 * 5/2010 Powell ..... G01J 5/04 359/227
7,766,734 B2 8/2010 Dietz et al.
7,809,429 B2 * 10/2010 Sato ..... A61B 5/0059 250/330
7,866,312 B2 * 1/2011 Erdmann ..... F24C 3/12 126/299 D
8,164,813 B1 * 4/2012 Gat ..... G02B 5/005 359/230
9,587,839 B2 * 3/2017 Burdett ..... F24C 15/2021
2003/0088338 A1 * 5/2003 Phillips ..... B67D 1/1204 700/282
2003/0104778 A1 6/2003 Liu
2003/0146082 A1 8/2003 Gibson et al.
2003/0185273 A1 * 10/2003 Hollander ..... G01J 5/02 374/121
2003/0201319 A1 * 10/2003 Patel ..... G06K 7/10861 235/383
2003/0207662 A1 11/2003 Liu
2003/0210340 A1 * 11/2003 Frederick Romanowich ..... G08B 13/19632 348/272
2004/0011349 A1 1/2004 Livchak et al.
2005/0007578 A1 1/2005 Ziemins et al.
2005/0098640 A1 5/2005 Ichishi et al.
2005/0115557 A1 6/2005 Meredith et al.
2005/0116168 A1 6/2005 Kaushal et al.
2005/0156053 A1 7/2005 Melink
2005/0185695 A1 * 8/2005 Hollander ..... G01J 5/02 374/121
2005/0229922 A1 10/2005 Magner et al.
2005/0279845 A1 * 12/2005 Bagwell ..... B08B 15/00 236/49.4
2006/0009147 A1 1/2006 Huang et al.
2006/0032492 A1 2/2006 Bagwell et al.
2006/0060187 A1 3/2006 Luddy et al.
2006/0208679 A1 * 9/2006 Lin ..... G05D 23/1905 318/471
2006/0219235 A1 10/2006 Bagwell et al.
2006/0268116 A1 * 11/2006 Finizio ..... G03B 17/00 348/207.99
2006/0268435 A1 * 11/2006 Finizio ..... G03B 17/00 359/819
2006/0278216 A1 * 12/2006 Gagas ..... F24C 15/2028 126/299 D
2007/0001111 A1 1/2007 Rueb et al.
2007/0015449 A1 1/2007 Livchak
2007/0023349 A1 2/2007 Kyllonen et al.
2007/0068509 A1 3/2007 Bagwell et al.
2007/0165353 A1 7/2007 Fleischer
2007/0183154 A1 8/2007 Robson
2007/0184771 A1 8/2007 Fluhrer
2007/0202791 A1 8/2007 Lee et al.
2007/0229293 A1 * 10/2007 Martino ..... G08B 17/103 340/630
2007/0272230 A9 11/2007 Meredith et al.
2008/0045132 A1 * 2/2008 Livchak ..... F24C 15/2021 454/61
2008/0138750 A1 * 6/2008 Kim ..... F23N 5/242 431/12
2008/0141996 A1 * 6/2008 Erdmann ..... F24C 3/12 126/299 D
2008/0207109 A1 8/2008 Bagwell et al.
2008/0258063 A1 10/2008 Rapanotti
2008/0297808 A1 * 12/2008 Riza ..... G01B 9/02004 356/503
2008/0302247 A1 12/2008 Magner et al.
2008/0308088 A1 12/2008 Livchak et al.
2009/0032011 A1 * 2/2009 Livchak ..... F24C 15/20 126/299 D
2009/0093210 A1 4/2009 Livchak et al.
2009/0199844 A1 8/2009 Meredith et al.
2009/0264060 A1 10/2009 Livchak et al.
2011/0226230 A1 9/2011 Reese et al.
2011/0269386 A1 11/2011 Burdett et al.
2011/0284091 A1 11/2011 Livchak et al.
2013/0213483 A1 8/2013 Bagwell et al.
2015/0369493 A1 12/2015 Banu et al.
2016/0047554 A1 2/2016 Parvin et al.
2016/0123603 A1 5/2016 Chen et al.
2016/0201925 A1 7/2016 Melink et al.
2016/0313011 A1 10/2016 Melink et al.

FOREIGN PATENT DOCUMENTS

AU 2933601 A 7/2001
BE 838829 A 6/1976
CA 1054430 A1 5/1979
CA 1069749 A2 1/1980
CA 1081030 A2 7/1980
CA 2536332 A1 3/2005
CH 682512 A 9/1993
CN 200949871 9/2007
CN 104412042 A 3/2015
CN 105209830 A 12/2015
DE 314477 9/1919
DE 2607301 9/1976

(56) References Cited

FOREIGN PATENT DOCUMENTS

| | | | | |
|---|---|---|---|---|
| DE | 2659736 | A1 | 7/1977 | |
| DE | 3519189 | A1 | 12/1986 | |
| DE | 4120175 | A1 | 2/1992 | |
| DE | 4114329 | A1 | 11/1992 | |
| DE | 4203916 | | 4/1993 | |
| DE | 19613513 | A1 | 10/1997 | |
| DE | 202010014337 | U1 | 2/2013 | |
| DE | 102014017833 | A1 | 6/2016 | |
| EP | 0314085 | A1 | 5/1989 | |
| EP | 0401583 | A1 | 12/1990 | |
| EP | 0541862 | A1 | 5/1993 | |
| EP | 0541863 | A1 | 5/1993 | |
| EP | 0623398 | A1 | 11/1994 | |
| EP | 0753706 | A1 | 1/1997 | |
| EP | 0881935 | A1 | 12/1998 | |
| EP | 1250556 | A1 | 10/2002 | |
| EP | 1386569 | A1 | 2/2004 | |
| EP | 1637810 | A1 | 3/2006 | |
| EP | 1778418 | A2 | 5/2007 | |
| EP | 1847203 | A1 | 10/2007 | |
| FI | 58971 | | 1/1981 | |
| FR | 2008451 | | 1/1970 | |
| FR | 2301778 | | 9/1976 | |
| FR | 2613923 | A1 | 10/1988 | |
| FR | 2619198 | A1 | 2/1989 | |
| FR | 2705766 | A1 | 12/1994 | |
| GB | 1452266 | A | 10/1976 | |
| GB | 1544445 | A | 4/1979 | |
| GB | 2054143 | A | 2/1981 | |
| GB | 2132335 | A | 7/1984 | |
| GB | 2214063 | A | 8/1989 | |
| GB | 2232346 | A | 12/1990 | |
| GB | 2266340 | A | 10/1993 | |
| HK | 1019417 | | 2/2000 | |
| JP | 51132645 | | 11/1976 | |
| JP | 60213753 | | 10/1985 | |
| JP | 62175540 | A * | 8/1987 | ..... F24F 13/075 |
| JP | 63091442 | | 4/1988 | |
| JP | 63251741 | | 10/1988 | |
| JP | 10084039 | | 3/1989 | |
| JP | 02033552 | | 2/1990 | |
| JP | 32047937 | | 11/1991 | |
| JP | 40000140 | | 1/1992 | |
| JP | 40062347 | | 2/1992 | |
| JP | 40068242 | | 3/1992 | |
| JP | 41013143 | | 4/1992 | |
| JP | 52048645 | | 9/1993 | |
| JP | 10288371 | | 10/1998 | |
| JP | H11514734 | | 12/1999 | |
| JP | 2000081216 | | 3/2000 | |
| JP | 2002089859 | | 3/2002 | |
| JP | 2003519771 | | 6/2003 | |
| JP | 2003269770 | | 9/2003 | |
| JP | 4346546 | B2 | 10/2009 | |
| JP | 5899393 | B2 | 4/2016 | |
| NL | 7601862 | | 8/1976 | |
| SE | 7602168 | | 8/1976 | |
| SE | 7904443 | | 11/1980 | |
| WO | 1986006154 | A1 | 10/1986 | |
| WO | 9117803 | | 11/1991 | |
| WO | 9208082 | | 5/1992 | |
| WO | 9748479 | | 12/1997 | |
| WO | 2001051857 | A1 | 7/2001 | |
| WO | 0183125 | | 11/2001 | |
| WO | 2001084054 | A1 | 11/2001 | |
| WO | 0214746 | | 2/2002 | |
| WO | 2002014728 | A1 | 2/2002 | |
| WO | 2003056252 | A1 | 7/2003 | |
| WO | 2005019736 | A1 | 3/2005 | |
| WO | 2005114059 | A2 | 12/2005 | |
| WO | 2006002190 | A2 | 1/2006 | |
| WO | 2006012628 | A2 | 2/2006 | |
| WO | 2006074420 | A2 | 7/2006 | |
| WO | 2006074425 | A1 | 7/2006 | |
| WO | 2006092303 | A1 | 9/2006 | |
| WO | 2007121461 | A2 | 10/2007 | |
| WO | 2007148842 | A1 | 12/2007 | |
| WO | 2008157418 | A1 | 12/2008 | |
| WO | 2009092077 | A1 | 7/2009 | |
| WO | 2009129539 | A1 | 10/2009 | |
| WO | 2013041518 | A1 | 3/2013 | |

OTHER PUBLICATIONS

Abstract for Tennekes et al., "A First Course of Turbulence", Mass. Inst. Tech., 1972.

International Search Report and Written Opinion dated Jan. 5, 2007, for International Application No. PCT/US05/26378 filed Jul. 25, 2005.

Morsi et al., "An Investigation of Particle Trajectories in Two-Phase Flow Systems", Journal of Fluid Mechanics, 1972, 55: pp. 193-208.

Non-Final Office Action, dated May 28, 2010, in U.S. Appl. No. 12/407,686.

Prosecution history of U.S. Appl. No. 07/010,277, now U.S. Pat. No. 4,811,724.

Saravelou et al., "Detailed Modeling of a Swirling Coal Flame", Combustion Science and Technology, 1997, 123: pp. 1-22.

Skimm, G.K., Technician's Guide to HVAC, 1995, McGraw-Hill, pp. 322-330.

Translation of foreign patent document DE 4203916.

* cited by examiner

AUTONOMOUS VENTILATION SYSTEM

CROSS REFERENCE TO RELATED APPLICATIONS

This application is a divisional of U.S. patent application Ser. No. 14/223,286 filed Mar. 24, 2014, which is a continuation application of U.S. patent application Ser. No. 13/187,762 filed Jul. 21, 2011, now U.S. Pat. No. 8,795,040 issued Aug. 5, 2014, which is a continuation application of U.S. patent application Ser. No. 11/947,924 filed Nov. 30, 2007, now abandoned, which claims the benefit of U.S. Provisional Application No. 60/968,395 filed Aug. 28, 2007, all of which are hereby incorporated by reference in their entirety herein.

TECHNICAL FIELD

This disclosure relates in general to control systems and more particularly to an autonomous ventilation system.

BACKGROUND

Ventilation systems are commonly found in modern residential, restaurant, and commercial kitchens. Heat, smoke, and fumes are an ordinary byproduct of cooking many foods and must be removed in order to protect the health and comfort of those present in the kitchen and adjacent areas. Ventilation systems provide an effective way to capture excessive heat, smoke, and fumes generated in kitchens and ventilate them to the atmosphere where they pose no threat to health or safety.

A typical ventilation system consists of an exhaust hood positioned over pieces of cooking equipment that are known to produce heat, smoke, or fumes. This exhaust hood is usually connected via ducts to an exhaust fan and in turn to a vent located on the outside of the building housing the kitchen. The exhaust fan is operated in a way to create a flow of air from the exhaust hood to the outside vent. This creates a suction effect at the exhaust hood that captures the air and any airborne contaminants around the hood. Consequently, any heat, smoke, or fumes generated by the cooking equipment will rise up to the overhead exhaust hood where it will be captured by the suction and transported out of the kitchen to the outside vent. There, it will dissipate harmlessly into the atmosphere.

Most ventilation systems must be manually activated and deactivated by the user. In a typical fast-food restaurant, for example, an employee must manually activate the kitchen ventilation system early in the day or before any cooking occurs. The system will then remain active in order to capture any smoke or fumes that may result from cooking.

The system must then be manually deactivated periodically, at the end of the day, or after all cooking has ceased. This manual operation of the ventilation system typically results in the system being active at times when ventilation is not actually required. This needlessly wastes energy not only associated with the operation of the ventilation system, but also due to the ventilation of uncontaminated air supplied to the kitchen by a heating and cooling system. By operating when no smoke or fumes are present, the ventilation system will remove other valuable air that was supplied to heat or cool the kitchen and thus cause the heating and cooling system to operate longer than it would have otherwise.

SUMMARY OF THE DISCLOSURE

The present disclosure provides an autonomous ventilation system that substantially eliminates or reduces at least some of the disadvantages and problems associated with previous methods and systems.

According to one embodiment, an autonomous ventilation system includes a variable-speed exhaust fan, a controller, an exhaust hood, and an infrared radiation ("IR") sensor. The exhaust fan removes air contaminants from an area. The controller is coupled to the exhaust fan and adjusts the speed of the exhaust fan. The exhaust hood is coupled to the exhaust fan and directs air contaminants to the exhaust fan. The IR sensor is coupled to the controller, detects changes in IR index in a zone below the exhaust hood, and communicates information relating to detected changes in IR index to the controller. The controller adjusts the speed of the exhaust fan in response to information relating to changes in IR index detected by the IR sensor. Other embodiments also include an alignment laser to visibly indicate a point at which the IR sensor is aimed and a field-of-view "FOV") indicator to illuminate the zone below the exhaust hood in which the IR sensor detects changes in IR index.

Technical advantages of certain embodiments may include a reduction in energy consumption, an increase in the comfort of the ventilated area, and a decrease in noise. Embodiments may eliminate certain inefficiencies such as needlessly ventilating valuable air from an area that was supplied by a heating, ventilation, and air conditioning ("HVAC") system.

Other technical advantages will be readily apparent to one skilled in the art from the following figures, descriptions, and claims. Moreover, while specific advantages have been enumerated above, various embodiments may include all, enumerated advantages.

BRIEF DESCRIPTION OF THE DRAWINGS

For a more complete understanding of the present disclosure and its advantages, reference is now made to the following description, taken in conjunction with the accompanying drawings, in which.

DETAILED DESCRIPTION OF THE DISCLOSURE

Figure 1:
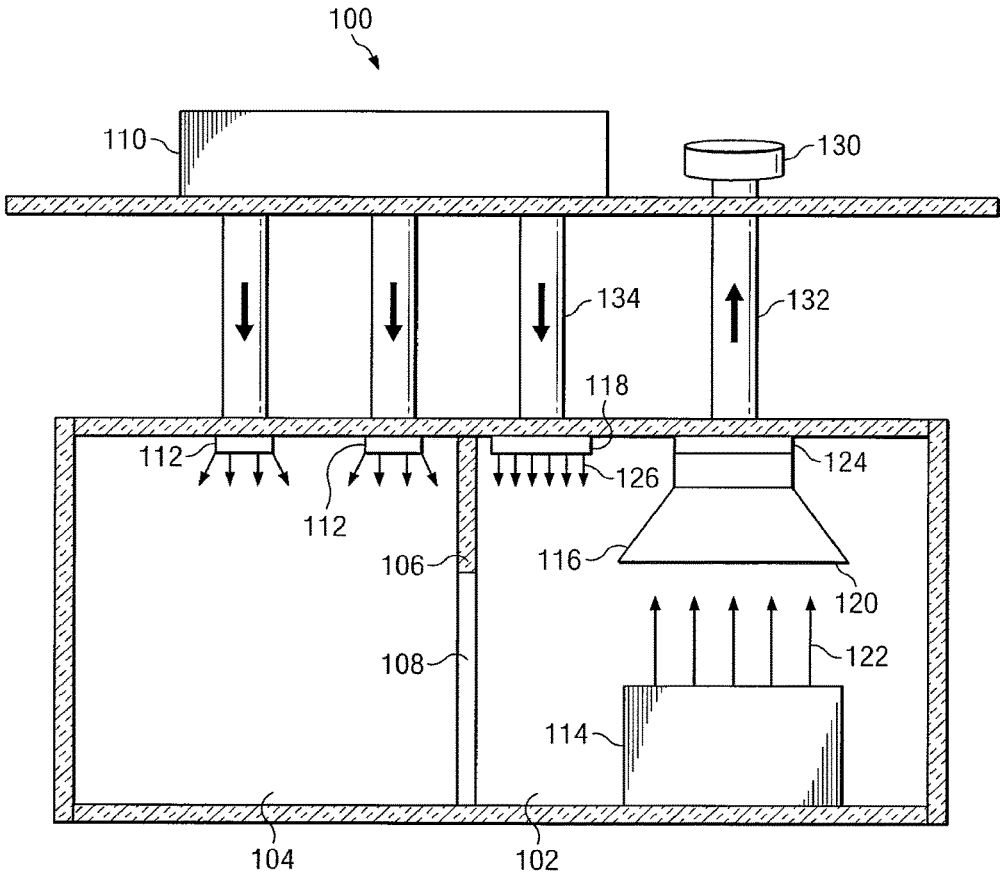
FIG. 1 is a simplified block diagram illustrating a facility requiring ventilation in accordance with a particular embodiment.

FIG. 1 depicts a facility 100 where a particular embodiment may be utilized. Facility 100 may be a restaurant, for example, that includes a kitchen 102 and at least one adjacent room 104 separated by a wall 106. Wall 106 contains a doorway 108 that allows access between kitchen 102 and adjacent room 104. Facility 100 also includes an HVAC system 110 that provides conditioned air to the interior of facility 100 via interior vents 112. Kitchen 102 includes one or more pieces of cooking equipment 114, an exhaust hood 116, a ceiling supply air vent 118, and a ceiling exhaust vent 124. Examples of cooking equipment 114 include, but are not limited to, stoves, cooktops, ovens, fryers, and broilers. Exhaust hood 116 is oriented such that a downward-facing opening 120 is operable to direct an air contaminant 122 associated with the operation of cooking equipment 114 through ceiling exhaust vent 124 and ultimately out an exterior exhaust vent 130 via an exhaust duct 132. Air contaminant 122 includes, but is not limited to, smoke, steam, fumes, and/or heat. Ceiling supply air vent 118 is connected to a supply air duct 134 and is operable to provide supply air 126. Supply air 126 may be supplied from HVAC system 110 and may include conditioned air (i.e., heated or cooled air) or unconditioned air. Supply air 126 may be supplied in an amount corresponding to the amount of air removed from kitchen 102 via exhaust hood 116 such that the air pressure inside kitchen 102 remains relatively constant.

Removing air contaminant 122 from kitchen 102 helps ensure that kitchen 102, as well as adjacent room 104, remains safe, sufficiently free of air contaminant 122, and at a comfortable temperature for anyone inside. The volume of air exhausted via exhaust hood 116 should be carefully regulated to minimize the quantity of conditioned air (air entering facility 100 through HVAC system 110) that is vacated from kitchen 102 and facility 100 while ensuring that enough air is ventilated to prevent buildup of air contaminant 122. Because a particular piece of cooking equipment 114 may not be in use at all times and thus will not continuously generate air contaminant 122, it becomes beneficial to vary the rate at which exhaust hood 116 ventilates air contaminant 22 from kitchen 102 as well as the rate at which ceiling supply air vent 118 supplies air to kitchen 102 as a means to conserve energy and increase occupant safety and comfort. The embodiments discussed below provide a convenient alternative to manually activating a ventilation system as the level of air contaminants fluctuates.

While facility 100 has been described in reference to a restaurant, it should be noted that there are many facilities in need of such ventilation systems. Such facilities include manufacturing facilities, industrial facilities, residential kitchens, and the like. Likewise, embodiments in this disclosure are described in reference to kitchen 102, but could be utilized in any facility requiring ventilation.

Figure 2:
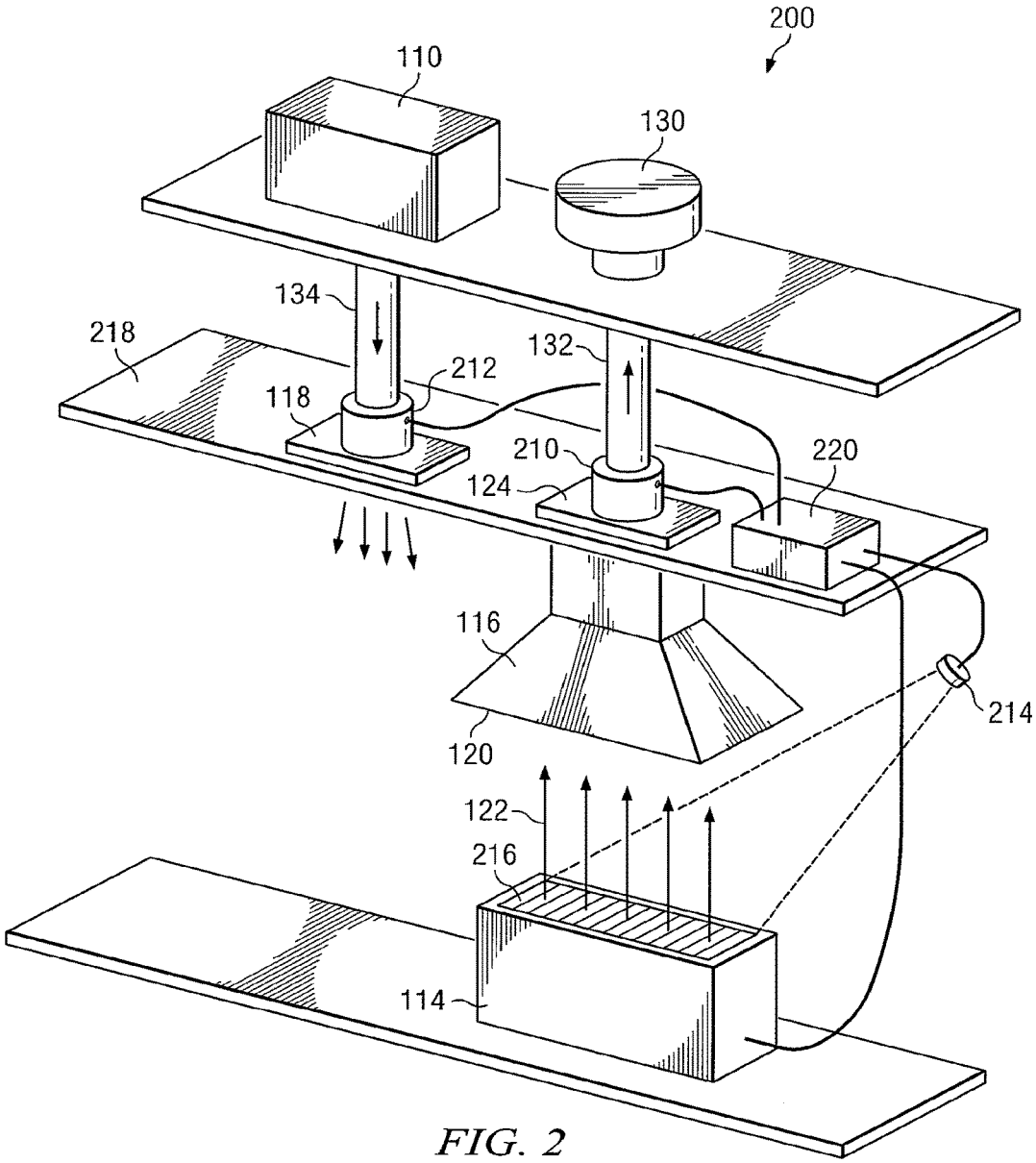
FIG. 2 is a simplified block diagram illustrating a ventilation system in accordance with a particular embodiment.

FIG. 2 depicts an autonomous ventilation system 200 as would be located inside kitchen 102 in accordance with a particular embodiment. Autonomous ventilation system 200 includes exhaust hood 116 with downward-facing opening 120. Exhaust hood 116 is coupled to ceiling exhaust vent 124 and is positioned above one or more pieces of cooking equipment 114. Air is drawn up through exhaust hood 116 via downward-facing opening 120 by an exhaust fan 210. Exhaust fan 210 may be positioned anywhere that allows it to draw air up through exhaust hood 116 including, but not limited to, inside exhaust hood 116 and exhaust duct 132. Autonomous ventilation system 200 also includes ceiling supply air vent 118 that can supply conditioned or unconditioned air to kitchen 102 from HVAC system 110. Air is supplied to kitchen 102 by a supply air fan 212 that is located in a position so as to create a flow of air through supply air dust 124 and ultimately out ceiling supply air vent 118. Autonomous ventilation system 200 also includes an IR sensor 214 that can detect IR index (the heat signature given off by an object) fluctuations in or about a cooking zone 216 associated with cooking equipment 114 beneath exhaust hood 116. According to a particular embodiment, IR sensor 214 is a thermopile sensor for remotely sensing infrared radiation changes in cooking zone 216. IR sensor 214, however, may be any type of IR sensor and is not limited in scope to a thermopile sensor. IR sensor 214 may be mounted inside exhaust hood 116, on top of exhaust hood 116, on a ceiling 218, or in any other position that allows it to detect IR index fluctuations in cooking zone 216 beneath exhaust hood 116. Cooking zone 116 may envelop an area adjacent to cooking equipment 114 or any portion of cooking equipment 114.

Autonomous ventilation system 200 is controlled by a controller 220. Controller 220 is coupled to IR sensor 214, exhaust fan 210, supply air fan 212, and/or cooking equipment 114. Controller 220 has auto-calibration and control logic that may be heuristically adjusted from observation of the environment, as discussed below. Controller 220 communicates with IR sensor 214 to observe the environment and determine IR index fluctuations in or about cooking zone 216. Controller 220 also communications with exhaust fan 210 to control its speed and consequently the rate of ventilation of autonomous ventilation system 200. In some embodiments, controller 220 additionally communicates with supply air fan 212 to control its speed and thus the amount of air that is re-supplied to kitchen 102. Controller 220 may also be coupled to cooking equipment 114 in order to determine when it has been turned on and off.

In operation, controller 220 automatically adjusts the speed of exhaust fan 210 and thus the ventilation rate of autonomous ventilation system 200 based on a schedule and/or certain conditions sensed by IR sensor 214. These conditions may include the energy level of cooking equipment 114, the state of IR sensor 214, the introduction of uncooked food into cooking zone 216, and/or the presence of excessive amounts of air contaminant 122.

First, controller 220 may turn exhaust fan 210 on and off and/or adjust its speed based on the energy level of cooking equipment 114. Controller 220 may observe cooking equipment 114 with IR sensor 214 and determine an average IR index for the cooking surface or cooking medium when it is not in use. When a user then activates cooking equipment 114, controller 220 may detect via IR sensor 214 the increase in the IR index of the cooking surface or the cooking medium and set the rate of exhaust fan 210 to an idle rate. This idle rate may be a fixed predetermined speed or it may be a speed based on the IR index as measured by IR sensor 214. Conversely, controller 220 may decrease the speed or completely turn off exhaust fan 210 when it is determined via IR sensor 214 that cooking equipment 114 has been turned off. To determine if cooking equipment 114 has been turned off, controller 220 may determine that the IR index of the cooking surface or cooking medium of cooking equipment 114 has decreased to or towards the typical IR index when not in use. In some embodiments, controller 220 may be additionally or alternatively coupled to cooking equipment 114 to detect when it has been activated and deactivated. By automatically controlling the ventilation rate based on the energy level of cooking equipment 114, autonomous ventilation system 200 alleviates disadvantages of other ventilation systems such as wasted energy and unnecessary noise.

In some embodiments, controller 220 may additionally or alternatively adjust the speed of exhaust fan 210 based on the state of IR sensor 214. In this configuration, controller 220 monitors whether sensor 214 has been activated by a user. When a user activates IR sensor 214, controller 220 will set the speed of exhaust fan 210 to a predetermined idle rate or a rate based on the IR index measured by IR sensor 214. In addition, a user may choose to override IR sensor 214 altogether. By pushing the appropriate override button, a user may choose to override IR sensor 214 and manually force controller 220 to increase the speed of exhaust fan 210. This allows the user manual control of autonomous ventilation system 200 when desired.

In addition or alternatively, controller 220 of autonomous ventilation system 200 may set the speed of exhaust fan 210 to a predetermined normal cooking rate when IR sensor 214 detects a drop in IR index in all or part of cooking zone 216 due to the introduction of uncooked or cold food. As examples only, IR sensor 214 may detect a drop in IR index in all or part of cooking zone 216 due to cold and/or uncooked food being placed over an active burner, cold and/or uncooked food (such as frozen hamburger patties) being placed at the input to a broiler, or uncooked french fries being placed into a fryer. As a result of detecting such an event and setting the speed of exhaust fan 210 to a predetermined normal cooking rate, autonomous ventilation system 200 will be operational and will ventilate any airborne contaminant 122 that may result in the ensuing cooking session.

Controller 220 may additionally or alternatively set the speed of exhaust fan 210 to a predetermined flare-up rate when IR sensor 214 detects a change in IR index in cooking zone 216 due to a flare-up in cooking. Such changes in IR index may include a decrease due to the presence of excessive amounts of air contaminant 122 such as smoke or vapor or it may be an increase due to the presence of excessive heat and/or flames. Conversely, controller 220 may decrease the speed or completely turn off exhaust fan 210 after a predetermined amount of cooking time or when IR sensor 214 detects an IR index corresponding to a low, non-cooking, or non flare-up condition. This will additionally increase the energy efficiency and comfort level of the kitchen while minimizing unneeded noise.

The idle, cooking, and flare-up rates of exhaust fan 210 may be determined in a variety of ways. For example, these rates may be preset and/or preprogrammed into controller 220 based on the type of cooking equipment and/or the type of food being cooked under exhaust hood 116. A user may also determine and/or adjust these rates heuristically by observing the operation of autonomous ventilation system 200 in the environment in which it is installed. Pre-determined times for particular cooking equipment could also be provided from a manufacturer or standards body. It should also be noted that even though three distinct rates have been identified, it is intended that the present disclosure encompass other rates as well. For example, controller 220 may gradually increase the rate of exhaust fan 210 over time from a lower rate such as the idle rate to a higher rate such as the cooking rate. Likewise, it may gradually decrease the rate of exhaust fan 210 over time from a higher rate such as the flare-up rate to a lower rate such as the cooking rate.

In some embodiments, controller 220 may also automatically control the speed of supply air fan 212 to provide a desired pressurization of kitchen 102. For example, it may set the speed of supply air fan 212 to match the speed of exhaust fan 210. As a result, the rate at which air is removed and supplied to kitchen 102 is approximately equal and thus the temperature and air pressure remains relatively constant. Controller 220 may also set the speed of supply air fan 212 to a speed that is greater than the speed of exhaust fan 210 to create positive pressure in kitchen 102. This ensures that the environment in kitchen 102 remains safe and comfortable regardless of how much air is being ventilated through exhaust hood 116.

Exhaust fan 210 and supply air fan 212 may be powered by various types of motors including, but not limited to, AC single-phase electrical motors, AC three-phase electrical motors, and DC electrical motors. The speeds of exhaust fan 210 and supply air fan 212 may be adjusted by controller 220 by modulating the frequency of the output of a variable frequency drive in the case of AC single-phase or three-phase electrical motors, by a phase cut modulation technique in the case of a single-phase motor or by changing voltage in case of a DC electrical motor.

Figure 3:
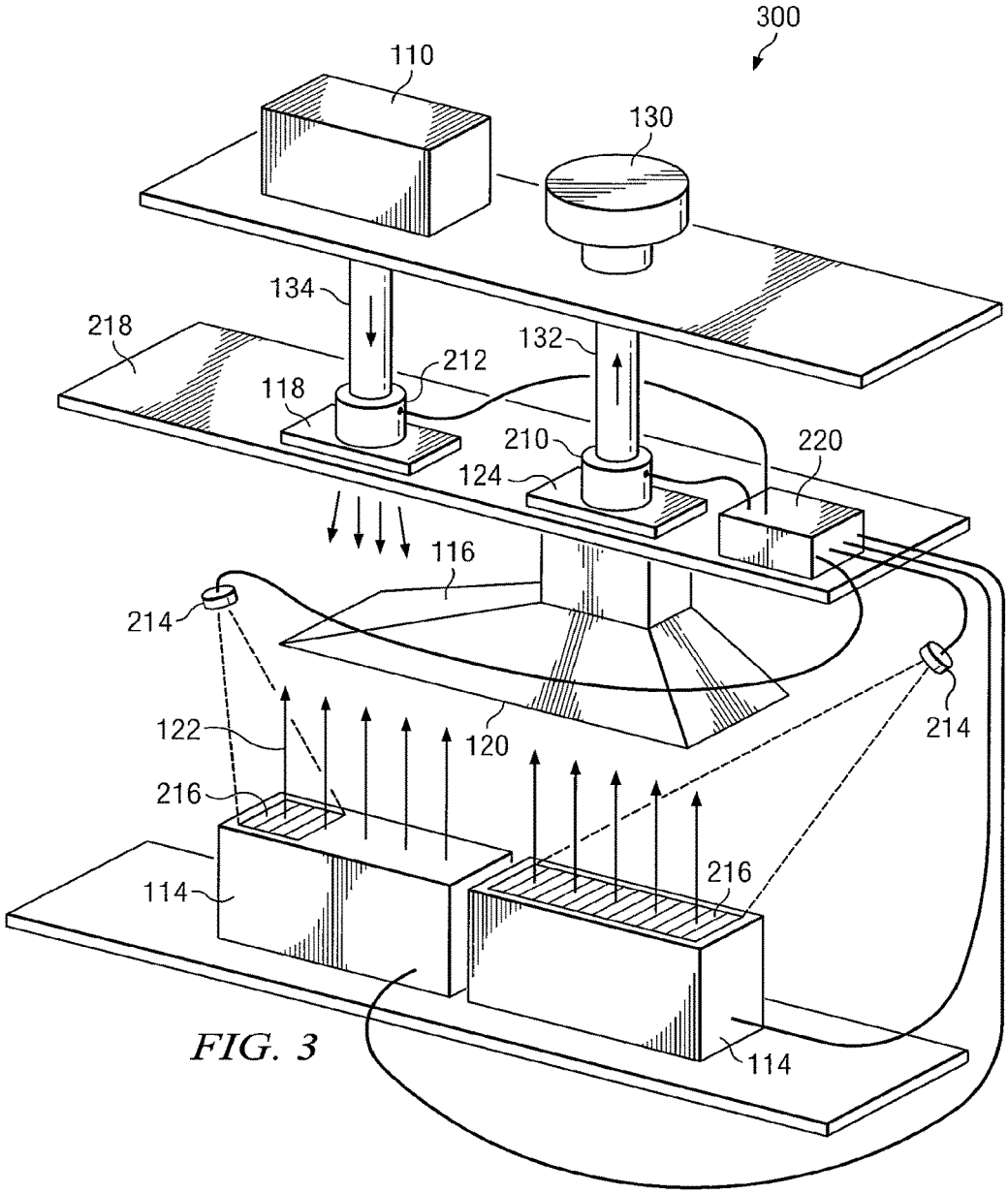
FIG. 3 is a simplified block diagram illustrating a ventilation system in accordance with another particular embodiment.

With reference now to FIG. 3, an additional embodiment of an autonomous ventilation system is provided. In this embodiment, an autonomous ventilation system 300 is operable to ventilate air contaminant 122 produced from more than one piece of cooking equipment 114. Autonomous ventilation system 300 comprises the same components described above in reference to autonomous ventilation system 200, but with minor modifications. In this embodiment, more than one IR sensor 214 and more than one piece of cooking equipment 114 are coupled to controller 220. Each IR sensor 214 can detect IR index fluctuations in or about a corresponding cooking zone 216 beneath exhaust hood 116. Exhaust hood 116 is positioned above the more than one piece of cooking equipment 114 and directs air contaminants 122 to ceiling exhaust vent 124.

In operation, controller 220 of autonomous ventilation system 300 adjusts the speed of exhaust fan 210 based on a schedule or certain conditions sensed by IR sensors 214 in a similar manner as described above in reference to autonomous ventilation system 200. For example, controller 220 may set the rate of exhaust fan 210 to an appropriate rate when any IR sensor 214 detects a change in the level of energy of any piece of cooking equipment 114 under exhaust hood 116. Controller 220 may set the speed of exhaust fan 210 to the default idle rate when it is determined via IR sensors 214 that any piece of cooking equipment 114 under exhaust hood 116 has been activated. Conversely, controller 220 may decrease the speed or completely turn off exhaust fan 210 when it is determined via IR sensors 214 that some or all of cooking equipment 114 has been turned off. In addition, controller 220 of autonomous ventilation system 300 may set the speed of exhaust fan 210 to a predetermined cooking rate based on the IR index in all or part of cooking zones 216 as determined by IR sensors 214. In this situation, controller 220 first determines the appropriate rate for each individual piece of cooking equipment 114. Such rates include, for example, the normal cooking rate and the flare-up rate as described above in reference to autonomous ventilation system 200. Controller 220 then sets the speed of exhaust fan 210 to the sum of the required rates of each of the pieces of cooking equipment 114 under exhaust hood 116 (or any other suitable speed including one based on the size and shape of exhaust hood 116 or the type of cooking equipment 114.) Controller 220 may conversely decrease the speed or completely turn off exhaust fan 210 after a predetermined amount of cooking time or when IR sensors 214 detect an IR index corresponding to a low, non-cooking, or non flare-up condition under exhaust hood 116.

Modifications, additions, or omissions may be made to autonomous ventilation system 300 and the described components. As an example, while FIG. 3 depicts two pieces of cooking equipment 114, two IR sensors 214, and two cooking zones 216, autonomous ventilation system 300 may be modified to include any number and combination of these items. Additionally, while certain embodiments have been described in detail, numerous changes, substitutions, variations, alterations and modifications may be ascertained by those skilled in the art. For example, while autonomous ventilation systems 200 and 300 have been described in reference to kitchen 102 and cooking equipment 114, certain embodiments may be utilized in other facilities where ventilation is needed. Such facilities include manufacturing facilities, industrial facilities, residential kitchens, and the like. It is intended that the present disclosure encompass all such changes, substitutions, variations, alterations and modifications as falling within the spirit and scope of the appended claims.

Figure 4A:
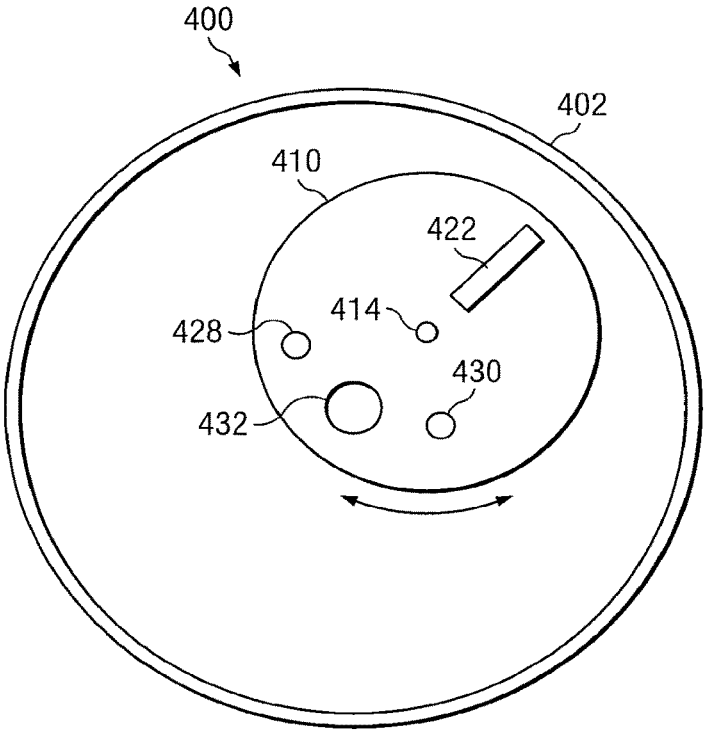
FIGS. 4A-4C are exploded views of an IR sensor assembly in accordance with a particular embodiment.
Figure 4B:
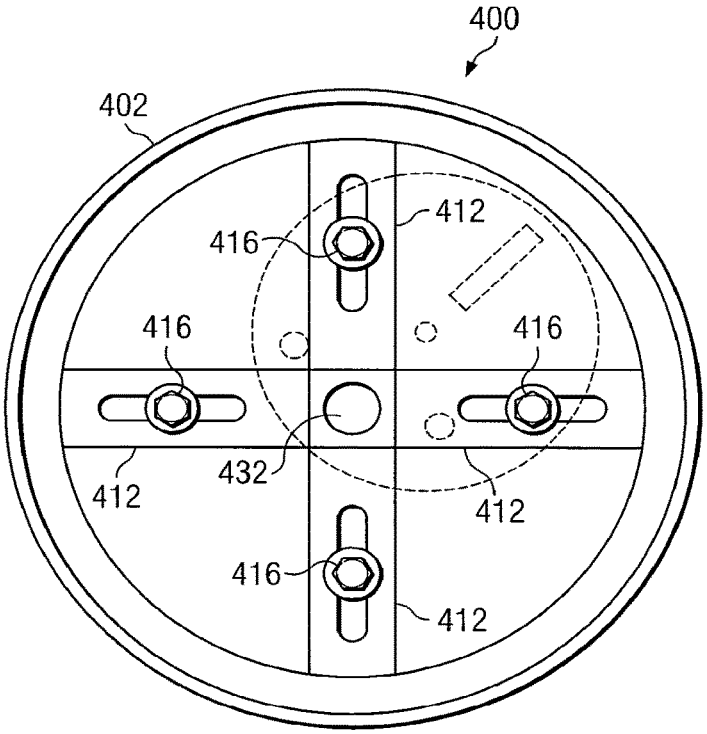
Figure 4C:
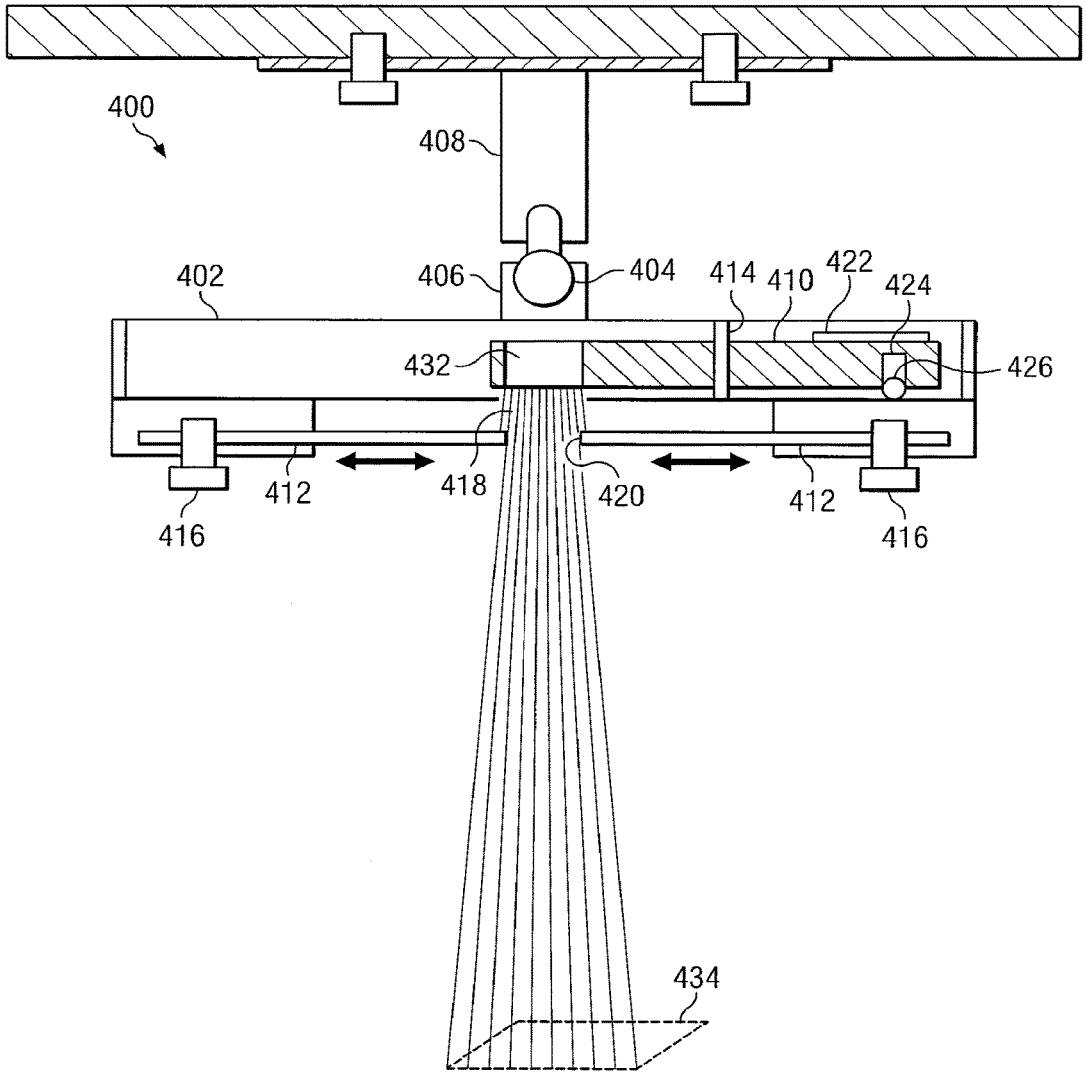

FIGS. 4A through 4C depict an IR sensor assembly 400, which could be utilized as IR sensor 214, discussed above in connection with FIGS. 2 and 3. FIG. 4A provides a top view of IR sensor assembly 400, FIG. 4B provides a bottom view of IR sensor assembly 400, and FIG. 4C provides a side view of IR sensor assembly 400.

IR sensor assembly 400 includes a housing 402, a ball joint 404, a ball joint bracket 406, and a mounting bracket 408. Ball joint 404 is coupled to mounting bracket 408 and housing 402 is coupled to ball joint bracket 406. Ball joint 404 fits inside ball joint bracket 406 and allows coupled housing 402 to rotate freely about ball joint 404.

Housing 402 includes a rotating turret 410, aperture shunts 412, an axel pin 414, aperture set screws 416, a fixed aperture 418, and an adjustable aperture 420. Fixed aperture 418 is located on one side of housing 402 and allows light and infrared radiation to pass in and out of housing 402. Aperture shunts 412 are affixed adjacent to fixed aperture 418 with aperture set screws 416. Aperture set screws 416 may be manually adjusted in a way that allows aperture shunts 412 to slide and block a portion, none, or all of the light that exits housing 402 via fixed aperture 418. The ends of aperture shunts 412 form adjustable aperture 420 whose shape may be manipulated by adjusting the position of one or more aperture shunts 412. Aperture shunts 416 may be black or otherwise dark in color to reduce disturbances in the light emitted from adjustable aperture 420.

Rotating turret 410 includes a rotation handle 422, a retention spring 424, a retention bearing 426, an alignment laser 428, a field-of-view ("FOV") indicator 430, and a thermopile sensor 432. Rotation handle 422 is affixed to rotating turret 410 and rotating turret 410 is affixed to housing 402 via axel pin 414. Rotating turret 410 is operable to rotate about axel pin 414 by grasping and applying force to rotation handle 422. Retention spring 424 is affixed to rotating turret 410 and is subsequently coupled to retention bearing 426. Retention spring 424 applies pressure to retention bearing 426 that is in contact with housing 402. This pressure creates resistance to the movement of rotating turret 410 and thus ensures rotating turret 410 does not rotate without sufficient force by the user. Alignment laser 428, FOV indicator 430, and thermopile sensor 432 are affixed to rotating turret 410 in such a way that each may be aligned with fixed aperture 418. When rotating turret 410 is rotated into the appropriate position, alignment laser 428, FOV indicator 430, and thermopile sensor 432 may each have a clear line-of-sight out of housing 402 via fixed aperture 418.

In operation, IR sensor assembly 400 is mounted with mounting bracket 408 in a location where it has a clear line-of-sight to an area to be monitored for IR index fluctuations. Once mounted in a desired location, housing 402 may be adjusted by pivoting housing 402 about ball joint 404. This allows three dimensional adjustments to aim IR sensor assembly 400 at the desired location. To select one of the attached instruments including alignment laser 428, FOV indicator 430, and thermopile sensor 432, the user grasps rotation handle 422 and rotates rotating turret 410 about axel pin 414 until the desired instrument is aligned with fixed aperture 418. This allows the selected instrument to have a clear line-of-sight out of housing 402.

To ensure IR sensor assembly 400 is aimed at the correct location to be monitored for IR index fluctuations, the user would first rotate rotating turret 410 to select FOV indicator 430. FOV indicator 430 may be any visible light emitting device including, but not limited to, a bright light LED. Once FOV indicator 430 is selected and activated, it will shine light out of housing 402 via fixed aperture 418. The result will be a field of view 434 which is a pattern of light on an object in the line-of-sight of FOV indicator 430 in the shape of fixed aperture 418. This corresponds with the field of view of thermopile sensor 432 when such sensor is rotated into position in line with aperture 418/420.

Initially, adjustable aperture 420 is larger in size than fixed aperture 418 and thus the shape of field of view 434 is controlled by fixed aperture 418. However, adjustable aperture 420 may be adjusted to overlap fixed aperture 418 in order to adjust the shape of field of view 434. The shape of adjustable aperture 420 and field of view 434 may be adjusted via aperture shunts 412 so that field of view 434 coincides with the desired area to be monitored for IR index fluctuations. In one embodiment, IR sensor assembly 400 is utilized as IR sensor 214 in autonomous ventilation system 200. Field of view 434 corresponds to cooking zone 216 and coincides with an area associated with cooking equipment 114 beneath exhaust hood 116. Field of view 434 may envelop any area associated with cooking equipment 114 including an area adjacent to cooking equipment 114 where uncooked food products are loaded for cooking, a portion of the surface of cooking equipment 114, or the entire surface of cooking equipment 114. To adjust the shape of field of view 434, one or more aperture set screws 416 are loosened to allow the associated aperture shunt 416 to slide freely. One or more aperture shunts 416 are adjusted so that one end overlaps fixed aperture 418. By overlapping fixed aperture 418, aperture shunts 412 will block light emitted via fixed aperture 418 and thus affect and control the shape of field of view 434. Once aperture shunts 416 are in the desired position and field of view 434 is in the desired shape, aperture set screws 416 are then tightened to secure aperture shunts from further movement and set the shape of adjustable aperture 420.

Once field of view 434 has been adjusted to match the area in which IR index fluctuations are to be monitored, the user may then rotate rotating turret 410 in order to use alignment laser 428 and/or thermopile sensor 432. For example, the user may rotate rotating turret 410 to align alignment laser 428 with fixed aperture 418. Alignment laser 428 may be any type of visible laser including a visible light laser diode. Once activated, alignment laser 428 will produce a point of light on any object in its line-of-sight. If IR sensor assembly 400 is aimed at a piece of equipment that is movable, this point of light produced by alignment laser 428 may be used to realign the piece of equipment back to the same position each time after it is moved. To do this, the user marks on the piece of equipment the location of the point of light produced by alignment laser 428 when it is in the desired position. After moving, the user would then reposition the piece of equipment so that the mark aligns with the point of light produced by alignment laser 428. This allows the piece of equipment to be easily realigned to the same position every time and prevents the user from having to continuously readjust field of view 434.

In addition, once field of view 434 has been adjusted to match the area in which IR index fluctuations are to be monitored, the user may rotate rotating turret 410 to align thermopile sensor 432 with fixed aperture 418 (this may be done regardless of the use of laser 428 as described above.) Once aligned with fixed aperture 418, thermopile sensor 432 will have the same field of view 434 as FOV indicator 430. Since thermopile sensor 432 does not emit visible light, the user would not be able to discern the field of view of thermopile sensor 432 without first utilizing FOV indicator 430. By utilizing both instruments, the user is able to finely tune the shape of field of view 434 and precisely select the area in which to monitor IR index fluctuations with thermopile sensor 432.

Modifications, additions, or omissions may be made to IR sensor assembly 400 and the described components. As an example, IR sensor assembly 400 may be designed to allow one or more of alignment laser 428, FOV indicator 430, and thermopile sensor 432 to be utilized at the same time. In such an embodiment, for example, a user may elect to illuminate field of view 434 with FOV indicator 430 while thermopile sensor 432 is monitoring IR index fluctuations in field of view 434. Other embodiments of IR sensor assembly 400 may not include alignment laser 428 or FOV indicator 430. Additionally, while certain embodiments have been described in detail, numerous changes, substitutions, variations, alterations and modifications may be ascertained by those skilled in the art, and it is intended that the present disclosure encompass all such changes, substitution s, variations, alterations and modifications as falling within the spirit and scope of the appended claims.

Figure 5A:
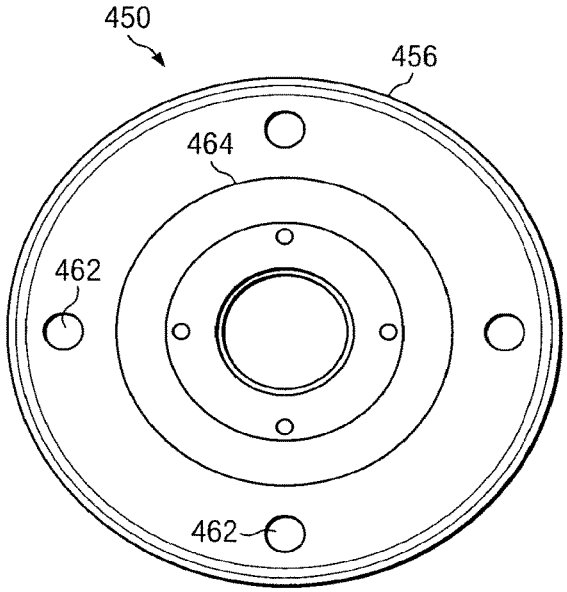
FIG. 5A is a top view of an IR sensor assembly in accordance with another particular embodiment.
Figure 5B:
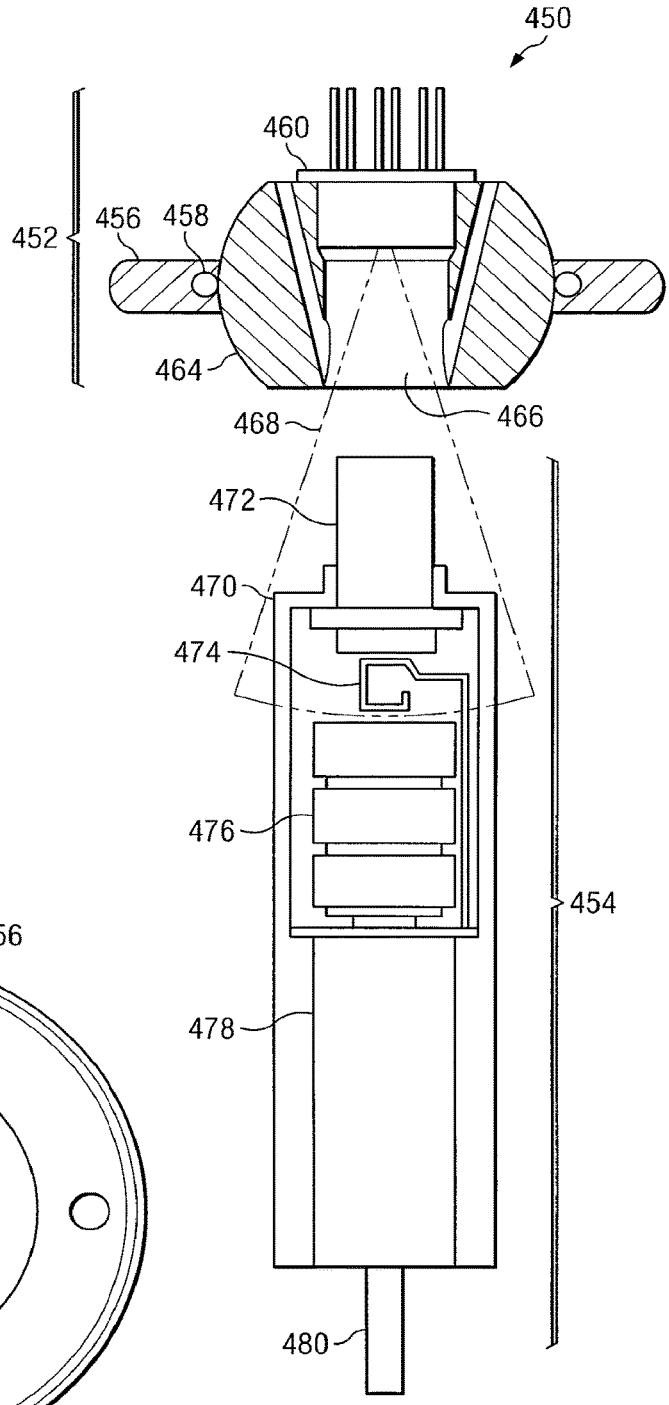
FIG. 5B is an exploded view of the IR sensor assembly shown in FIG. 5A.

FIG. 5 depicts an IR sensor assembly 450, which could be also be utilized as IR sensor 214, discussed above in connection with FIGS. 2 and 3. IR sensor assembly 450 includes an eyeball housing assembly 452 and a laser calibration assembly 454.

Eyeball housing assembly 452 includes a retaining bracket 456, a position-fixing o-ring 458, and a ball housing 464. Retaining bracket 456 contains mounting holes 462 that allow it to be attached with fasteners such as screws to any surface. Retaining bracket 456 also contains a round void that is large enough to allow ball housing 464 to partially fit through. Position-fixing o-ring 458 is attached to retaining bracket 456 about the circumference of the round void and makes contact with ball housing 464 when it is placed into the round void. Retaining bracket 456 and position-fixing o-ring 458 together form a socket in which ball housing 464 pivots.

Ball housing 464 contains an aperture 466 and an IR sensor 460. IR sensor 460 is affixed to ball housing 464 on the opposite side of aperture 466 in such a way that allows it to have a line-of-sight through ball housing 464 and out aperture 466. IR sensor 460 receives an IR field 468 through ball housing 464 and aperture 466. IR sensor 460 detects IR index fluctuations inside IR field 468. IR field 468 is in the shape of aperture 466 which may be any shape including round as shown in FIG. 5. In some embodiments, the shape of aperture 466 is adjustable by a user similar to how the airflow of an eyeball air vent is adjusted on many commercial airlines.

Laser calibration assembly 454 includes a housing 470, an activation button 472, a spring switch 474, coin cell batteries 476, and a diode laser 478. Housing 470 contains an opening at each end. Diode laser 478 is enclosed inside housing 470 in such a way as to allow it to shine a visible calibration beam 480 through the opening of one end of housing 470. Activation button 472 is also enclosed inside housing 470 and partially protrudes out of the opening in housing 470 opposite from calibration beam 480. Activation button 472 is in the shape of aperture 466 on ball housing 464 and is slightly smaller to allow it to easily slide into and out of aperture 466. For example, activation button 472 may be cylindrical in shape to allow it to fit into an aperture 466 that is round as seen in FIG. 5. Activation button 472 is also slightly smaller than the opening of housing 470 from which it protrudes. This allows it to move in and out of housing 470 through the opening. A lip adjacent to one end of activation button 472, however, prevents the button from sliding completely out of housing 470.

One or more coin cell batteries 476 are positioned adjacent to diode laser 478 inside housing 470. Enough coin cell batteries 476 are provided to power diode laser 478, causing it to produce visible calibration beam 480. Coin cell batteries 476 are positioned inside housing 470 so that only one terminal (positive or negative) of coin cell batteries 476 is coupled to diode laser 478. Spring switch 474 is positioned inside housing 470 between the other (uncoupled) terminal of coin cell batteries 476 and activation button 472. It is coupled to diode laser 478 on one end and activation button 472 on the other. A small gap of air exists between spring switch 474 and the uncoupled terminal of coin cell batteries 476 when laser calibration assembly is inactive so that the electrical circuit between coin cell batteries 476 and diode laser 478 is not complete.

In operation, eyeball housing assembly 452 is mounted with retaining bracket 456 in a location where it has a clear line-of-sight to an area to be monitored for IR index fluctuations. Once mounted in a desired location, eyeball housing assembly 452 may be adjusted by pivoting ball housing 464. This allows three dimensional adjustments to aim IR sensor 460 at the desired location. This is similar in operation to an eyeball air vent that is typical in most commercial airlines. Ball housing 464 pivots about the void in retaining bracket 456 and maintains its position after adjustments due to the pressure applied by position-fixing o-ring 458.

Because IR sensor 460 produces IR field 468 that is invisible to the human eye, it is difficult to reliably determine exactly where IR sensor assembly 450 is aimed. To alleviate this problem, a user may utilize laser calibration assembly 454. To do so, a user first inserts the end of laser calibration assembly 454 containing activation button 472 into aperture 466 of ball housing 464. Activation button 472 will slide into aperture 466 for a certain distance until it comes into contact with a portion of ball housing 464 or IR sensor 460 that impedes its movement. At this point, the user continues to apply pressure to IR sensor assembly 450 in the direction of ball housing 464. This will cause housing 470 to then slide toward ball housing 464 while activation button 472 remains immobile. This causes the end of activation button 472 inside housing 470 to contact spring switch 474 and in turn causes spring switch 474 to contact the uncoupled terminal of coin cell batteries 476. This completes the electrical circuit between coin cell batteries 476 and diode laser 478 and produces visible calibration beam 480. While still grasping laser calibration assembly 454, the user may then adjust IR sensor assembly 450 by pivoting ball housing 464 about retaining bracket 456. Since laser calibration assembly 454 is still inserted into aperture 466 of ball housing 464 when the user makes this adjustment, diode laser 478 will be aligned with IR sensor 460. As a result, visible calibration beam 480 will be produced that is aligned with invisible IR field 468. The user may then adjust IR sensor assembly 450 by pivoting ball housing 464 until visible calibration beam 480 is in the desired position. Once in the desired position, the user finally removes laser calibration assembly 454 and allows IR field 468 to be received by IR sensor 460 through aperture 466 from the desired target.

Figure 6A:
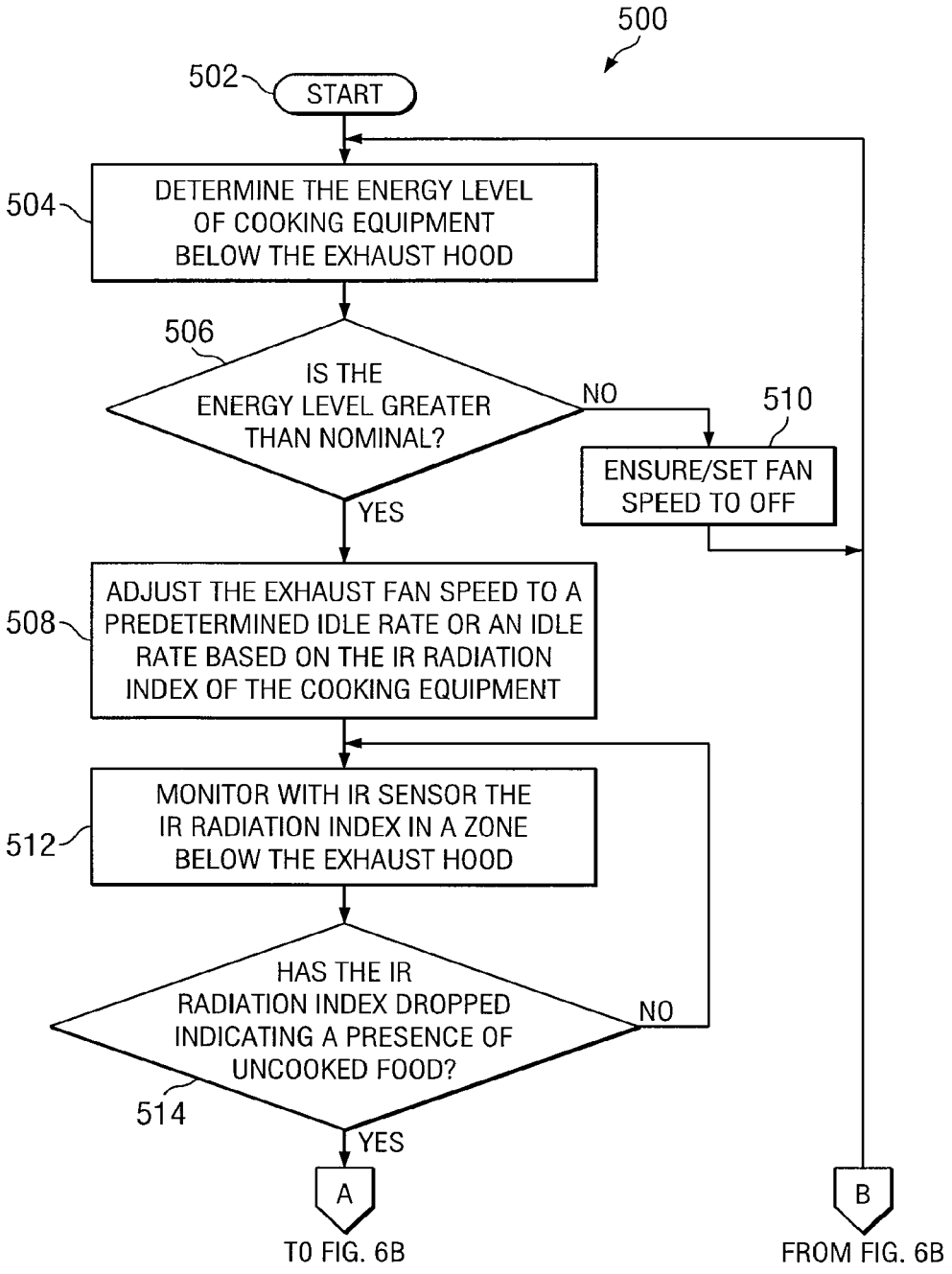
FIGS. 6A-6B illustrate a method of controlling a ventilation system in accordance with a particular embodiment.
Figure 6B:
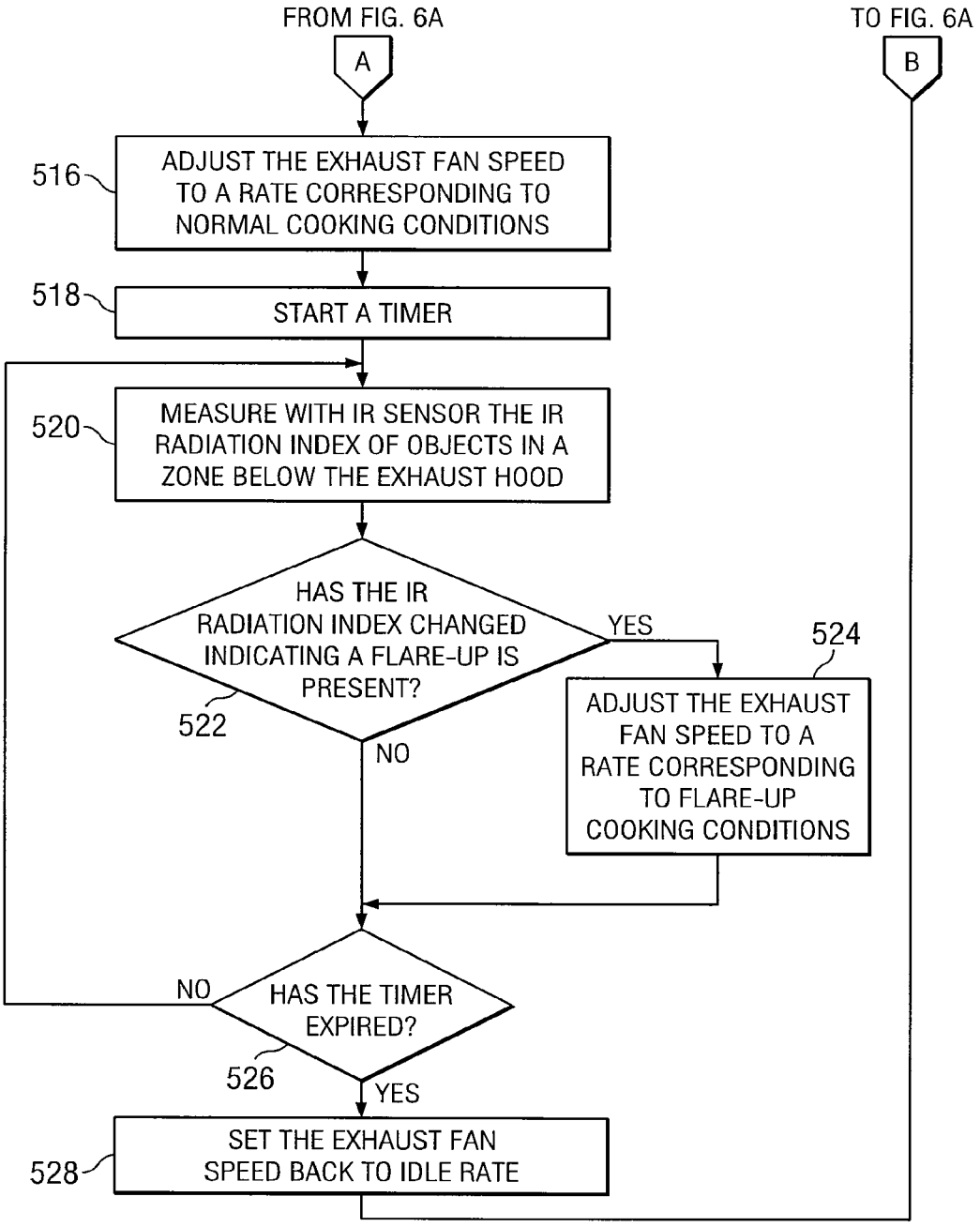

With reference now to FIG. 6, an autonomous ventilation control method 500 is provided. Autonomous ventilation control method 500 may be implemented, for example, by controller 220 described in reference to autonomous ventilation systems 200 and 300 in FIGS. 2 and 3 above. Autonomous ventilation control method 500 will now be described in reference to controller 220 as utilized in kitchen 102. It must be noted, however, that autonomous ventilation control method 500 may be utilized by any controller to control a ventilation system regardless of location.

Autonomous ventilation control method 500 begins in step 504 where the energy level of cooking equipment 114 is determined or where the activation of the equipment is otherwise determined. The energy level of cooking equipment 114 may be determined by any suitable technique, including utilizing IR sensor 214 to determine the IR index of the cooking surface or cooking medium of cooking equipment 114 or determining the state/settings of equipment controls through a connection with controller 220. In step 506, a decision is made based on the energy level determined in step 504. For example, if the IR index of the cooking surface or cooking medium of cooking equipment 114 is not greater than the average IR index when not in use (i.e., the energy level is low or zero), it is determined that no ventilation is required. As a result, exhaust fan 210 is turned off if it is not already off and autonomous ventilation control method 500 proceeds back to step 504. If, however, the IR index of the cooking surface or cooking medium of cooking equipment 114 determined in step 504 is greater than the average IR index when not in use (or if the energy level is otherwise determined to be above a particular threshold), autonomous ventilation control method 500 proceeds to step 508 where the speed of exhaust fan 210 is a set to an idle rate. The idle rate may be, for example, a predetermined rate or a rate based on the measured IR index.

Once it is determined in steps 504 and 506 that cooking equipment 114 has been activated, autonomous ventilation control method 500 next proceeds to monitor cooking zone 216. In step 512, the IR index of cooking zone 216 is monitored with IR sensor 214. In step 514, the IR index (or changes in IR index) of cooking zone 216 is analyzed to determine if uncooked (i.e., cold) food has been introduced. If it is determined in step 514 that a drop in IR index has occurred due to uncooked food being introduced into cooking zone 216, the speed of exhaust fan 210 is adjusted to a predetermined normal cooking rate in step 516. In particular embodiments, the speed may be adjusted based on the amount of the drop in IR index determined in step 514.

After adjusting the speed of exhaust fan 210 to a predetermined normal cooking level, autonomous ventilation control method 500 may next proceed to start a timer in step 518. The length of the timer in step 518 determines how long exhaust fan 210 remains at the cooking rate. The length of the timer may be based on the amount of IR index drop caused by the introduction of food into cooking zone 216. The larger the drop in IR index measured in step 512, the more uncooked or cold food has been introduced into cooking zone 216. The length of the timer set in step 518 may also be a fixed amount of time corresponding to the type of cooking equipment and/or food being cooked or it may be an amount of time programmed by a user. Note that in some embodiments, a timer my not be used at all to determine how long exhaust fan 210 remains at the cooking rate. In such an embodiment, IR sensor 214 may be used to determine when cooking is complete and set exhaust fan 210 back to the idle rate.

After setting the timer in step 518, autonomous ventilation control method 500 may next proceed to monitor cooking zone 216 for flare-ups. A flare-up condition occurs when excessive amounts of air contaminants 122 such as steam, smoke, or heat are produced by cooking with cooking equipment 114. To determine if a flare-up exists, the IR index of cooking zone 216 is measured with IR sensor 214 in step 520. In step 522, the IR index is analyzed to determine if a change in IR index has occurred due to the presence of excessive amounts of air contaminants 122. The change in IR index may include a decrease associated with excessive amounts of smoke, steam, or vapor or it may be an increase associated with excessive amounts of heat from flames. If a flare-up condition exists, the speed of exhaust fan 210 is increased from the normal cooking rate to a predetermined flare-up rate. If no flare-up condition exists, the speed of the exhaust fan 210 is maintained at the normal cooking rate.

Next, autonomous ventilation control method 500 proceeds to determine in step 526 if the timer set in step 518 has expired. If the timer has expired, the speed of exhaust fan 210 is decreased to the idle rate in step 528 and autonomous ventilation control method 500 proceeds back to step 504 to monitor the energy level of cooking equipment 114. If the timer has not expired, autonomous ventilation control method 500 proceeds back to step 520 to monitor for flare-up conditions. Alternatively, if a timer is not used in a particular embodiment, IR sensor 214 may be used in step 526 to determine when cooking is complete and proceed to the next step.

While a particular autonomous ventilation control method has been described, it should be noted that certain steps may be rearranged, modified, or eliminated where appropriate. Additionally, while certain embodiments have been described in detail, numerous changes, substitutions, variations, alterations and modification s may be ascertained by those skilled in the art, and it is intended that the present disclosure encompass all such changes, substitutions, variations, alterations and modifications as falling within the spirit and scope of the appended claims.

What is claimed:

1. An autonomous ventilation system, comprising:

an exhaust fan operable to remove air from an area;

a controller coupled to the exhaust fan and operable to adjust the speed of the exhaust fan;

an exhaust hood coupled to the exhaust fan, the exhaust hood operable to direct the air from the area to the exhaust fan;

an aperture assembly having an aperture and one or more adjustable shunts;

an infrared radiation ("IR") sensor coupled to the controller and configured to, when aligned with the aperture, detect a change in IR index in a zone below the exhaust hood and to communicate information relating to the detected change in IR index to the controller, wherein the controller is operable to adjust the speed of the exhaust fan in response to the information, wherein the one or more adjustable shunts of the aperture assembly are operable to adjust the zone below the exhaust hood in which the IR sensor is operable to detect the change in IR index; and a field-of-view ("FOV") indicator configured to, when aligned with the aperture, visibly identify to an operator of the autonomous ventilation system boundaries of the zone below the exhaust hood in which the IR sensor is operable to detect the change in IR index, wherein adjusting the one or more adjustable shunts causes the FOV indicator to, when aligned with the aperture, visibly identify to the operator corresponding adjusted boundaries of the adjusted zone.

2. The autonomous ventilation system according to claim 1, further comprising:

an alignment laser operable to, when aligned with the aperture, visibly indicate a point at which the IR sensor is to be aimed.

3. The autonomous ventilation system according to claim 2, wherein the IR sensor, the FOV indicator, and the alignment laser are selectable for mutually exclusive operation.

4. The autonomous ventilation system according to claim 2, wherein the IR sensor, the FOV indicator, and the alignment laser are configured to pivot about an axis to a plurality of different positions.

5. The autonomous ventilation system according to claim 2, further comprising:

a rotating turret supporting the IR sensor, the alignment laser, and the FOV indicator, wherein the rotating turret and the aperture are constructed such that only one of the IR sensor, the alignment laser, and the FOV indicator is aligned with said aperture at a time.

6. The autonomous ventilation system according to claim 1, wherein the exhaust hood is located above one or more pieces of cooking equipment.

7. The autonomous ventilation system according to claim 1, wherein the IR sensor comprises a thermopile sensor.

8. The autonomous ventilation system according to claim 1, further comprising:

a variable-speed supply fan coupled to the controller, the variable-speed supply fan operable to deliver air to the area.

9. The autonomous ventilation system according to claim 6, wherein:

the IR sensor is operable to detect a decrease in IR index caused by an introduction of a food product to the zone below the exhaust hood; and the controller is operable to adjust the speed of the variable-speed exhaust fan to a predetermined speed for a predetermined period of time associated with cooking of the food product.

10. The autonomous ventilation system according to claim 6, wherein:

the IR sensor is operable to detect a decrease in IR index associated with an air contaminant produced by a food product being cooked in the zone below the exhaust hood; and the controller is operable to adjust the speed of the variable-speed exhaust fan to a predetermined speed operable to remove the air contaminant.

11. The autonomous ventilation system according to claim 1, wherein the controller is further operable to:

monitor an energy level of a piece of equipment below the exhaust hood;

adjust the variable-speed exhaust fan predetermined idle speed when the energy level of the piece of equipment below the exhaust hood indicates the equipment has been turned on; and turn the variable-speed exhaust fan off when the energy level of the piece of equipment below the exhaust fan indicates the equipment has been turned off.

12. The autonomous ventilation system according to claim 1, further comprising:

an eyeball housing assembly operable to pivot about a socket to adjust where the IR sensor is aimed.

13. The autonomous ventilation system according to claim 12, further comprising:

a laser calibration assembly operable to be coupled to the eyeball housing assembly and generate a visible calibration beam to align the IR sensor.

14. The autonomous ventilation system according to claim 1, further comprising:

a rotating turret supporting at least the IR sensor.

15. The autonomous ventilation system according to claim 1, wherein the one or more adjustable shunts are operable to adjust the size of the area where the IR sensor is operable to detect the change in IR index by changing a size and/or shape of the aperture of the aperture assembly.

16. A method of ventilating an area by an autonomous ventilation system that comprises an exhaust fan associated with an exhaust hood and being operable to remove an air contaminant from the area, the method comprising:

sensing an IR index change in a zone below the exhaust hood using an infrared radiation (IR) sensor when the IR sensor is aligned with an aperture of an aperture assembly, wherein the zone is adjusted by operating one or more adjustable shunts of the aperture assembly when a field-of-view ("FOV") indicator is aligned with the aperture, wherein boundaries of the zone are visibly identified to an operator of the exhaust hood by the FOV indicator when the FOV indicator is aligned with the aperture;

communicating information relating to the sensed IR index change to a controller; and adjusting the speed of the exhaust fan using the controller based on the IR index change sensed by the IR sensor in the zone below the exhaust fan.

17. The method of ventilating an area according to claim 16, wherein an alignment laser is operable to visually indicate a point at which the IR sensor is to be aimed.

18. The method of ventilating an area according to claim 16, wherein the exhaust hood is located above one or more pieces of cooking equipment and the method further comprises:

adjusting the speed of the exhaust fan to a predetermined speed for a predetermined period of time when the controller detects cooking of a food product based on a decrease in IR index sensed by the IR sensor.

19. The method of ventilating an area of claim 16, further comprising:

monitoring an energy level of a piece of equipment below the exhaust hood;

adjusting the variable-speed exhaust fan to a predetermined idle speed when the energy level of the piece of equipment below the exhaust hood indicates the equipment has been turned on; and turning the variable-speed exhaust fan off when the energy level of the piece of equipment below the exhaust fan indicates the equipment has been turned off.

20. The method of ventilating an area according to claim 16, wherein a rotating turret supports the IR sensor and the FOV indicator, wherein the rotating turret and the aperture are constructed such that only one of the IR sensor and the FOV indicator is aligned with said aperture at a time.

* * * * *